United States Patent [19]

Gakiya

[11] 4,298,148

[45] Nov. 3, 1981

[54] HAND DEVICE FOR MAKING A BIAS TAPE

[75] Inventor: Yoshiaki Gakiya, Habikino, Japan

[73] Assignee: Clover Mfg. Co., Ltd., Osaka, Japan

[21] Appl. No.: 110,213

[22] Filed: Jan. 7, 1980

[30] Foreign Application Priority Data

Mar. 16, 1979 [JP] Japan ..... 54-34622[U]

[51] Int. Cl.[3] ..... A41H 33/00

[52] U.S. Cl. ..... 223/37

[58] Field of Search ..... 223/37, 38; 270/93; 112/141, 147, 152

[56] References Cited

U.S. PATENT DOCUMENTS

| | | | |
|---|---|---|---|
| 229,447 | 6/1880 | Moorefield | 223/37 X |
| 231,896 | 9/1880 | Brag | 223/37 X |
| 1,001,443 | 8/1911 | Rand et al. | 223/37 X |
| 1,018,227 | 2/1912 | Althen | 223/37 X |
| 1,537,118 | 5/1925 | Kent | 223/37 X |
| 1,723,543 | 8/1929 | Santis | 223/37 |
| 1,771,328 | 7/1930 | Gabel | 223/37 |
| 2,708,113 | 5/1955 | Currie | 223/37 X |
| 2,717,779 | 9/1955 | Currie | 223/37 X |

*Primary Examiner*—Louis Rimrodt

*Attorney, Agent, or Firm*—Birch, Stewart, Kolasch and Birch

[57] ABSTRACT

A hand device for making a bias tape for use in dressmaking and/or tailoring comprises an outer tubular member made of metallic sheet material and formed with a substantially oval rear end opening as well as a slit-shaped front end opening, an internal solid member formed of synthetic resin material and disposed within the outer tubular member so as to provide a tape-folding passage between the outer tubular member and the internal solid member. The passage has a substantially U-shaped configuration in cross section at its rear end and is gradually changed in its configuration so as to finally provide a substantially flat annular configuration is cross section at its front end.

5 Claims, 7 Drawing Figures

HAND DEVICE FOR MAKING A BIAS TAPE

BACKGROUND AND SUMMARY OF THE INVENTION

This invention relates to a hand device for making a bias tape, a narrow strip of cloth cut out on the bias, folded and used chiefly for finishing, strengthening, and/or decorating clothings.

A known bias tape making device essentially consists of an outer metal plate and an inner metal plate assembled together so as to provide a tubular body of a specific configuration.

In order to clarify distinctive features of the device according to the present invention, as compared to the conventional ones, description is now made in detail with reference to the accompanying drawings, in particular to FIGS. 5 and 6 in which a typical example of the known bias tape making device is illustrated.

The prior art device (A) herein illustrated has an outer plate (a) and an inner plate (b), both of which are formed by bending of metallic sheet material, respectively. The plates (a), (b) are connected together by spot-welding or soldering at such positions as indicated by (p), (q) in FIGS. 5,6, so that a tape-folding passage (c) is internally formed between the plates (a), (b).

According to this conventional method, however, difficult and complicated shaping processes are required for obtaining the accurately formed plates (a), (b), because some parts of each of the plates (a), (b) must be bent at very small radii in order to provide the specific construction as shown in FIGS. 5,6. In addition, a spot-welding or soldering process is required for connecting the plates (a), (b) together, which also invites an increase in the manufacturing cost. As a result, the conventional device is expensive to manufacture, poor in accuracy, difficult to mass-produce in uniform quality, and undesirably breakable occasionally in use at welded or soldered positions (p), (q), especially at position (p).

It is an object of the present invention to eliminate the above discussed disadvantages in the conventional device.

Another object of the invention is to provide an improved bias tape making device which is easy to manufacture at a lower manufacturing cost, better in durability, and capable of mass-production in uniform quality.

A further object of the invention is to provide an improved bias tape making device which can be manufactured without any welding or soldering process.

Other objects, features and advantages of the invention will become apparent from the detailed description given hereinafter in connection with the accompanying drawings. It should be understood, however, that the detailed description and a specific example while indicating a preferred embodiment of the invention, are given by way of illustration only, since various changes and modifications within the spirit and scope of the invention will be apparent to those skilled in the art from this detailed description.

BRIEF DESCRIPTION OF THE DRAWINGS

In the accompanying drawings

DESCRIPTION OF THE PREFERRED EMBODIMENT

Figure 1:
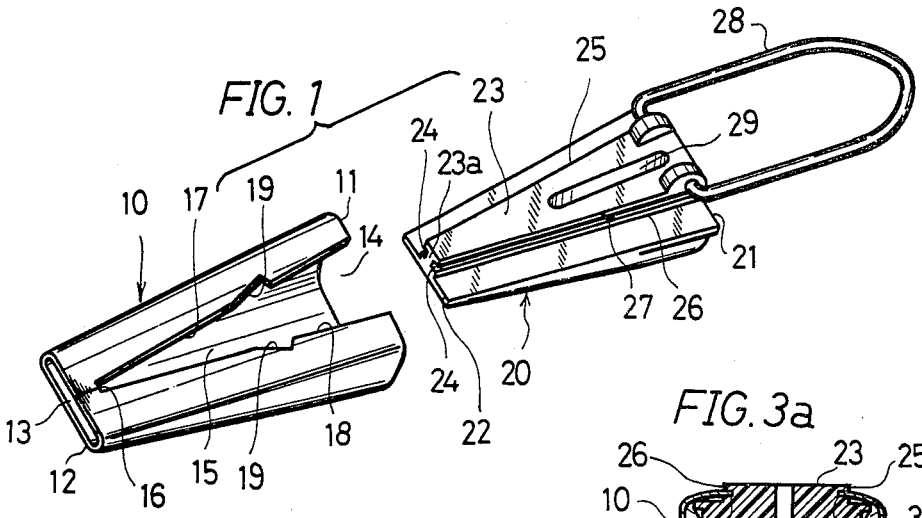
FIG. 1 is a perspective view showing an outer tubular member and an internal solid member before they are assembled together.

Referring now to the drawings, wherein identical reference numerals are used throughout the various views to indicate identical elements, the bias tape making device of the present invention has an outer tubular member 10 made of a metal sheet material and an internal solid member 20 made of synthetic resin material. The outer member 10 may be formed by punching and then bending so as to provide a tubular configuration. The internal member 20 may be formed by molding.

The outer member 10 is gradually reduced or tapered from its rear end 11 to its front end 12 so as to provide a slit-shaped front end opening 13 and a substantially oval rear end opening 14. The outer member 10 has a top opening 15 of a substantially triangular shape defined by a vertex 16 positioned near said front end 12 and a pair of side edges 17, 18 divergently extending from said vertex 16. Each of the edges 17, 18 may be formed with a notch 19 at a desired position. The notch may preferably be triangular in shape so that it can be easily engaged with a cooperating wedge-shaped projection 27 to be hereinafter described.

Figure 3A:
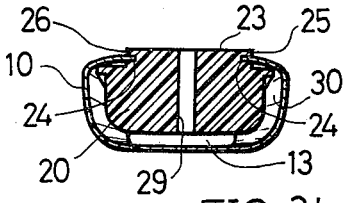
FIG. 3*a* is a cross section taken along the line 3*a*—3*a* of FIG. 2.
Figure 2:
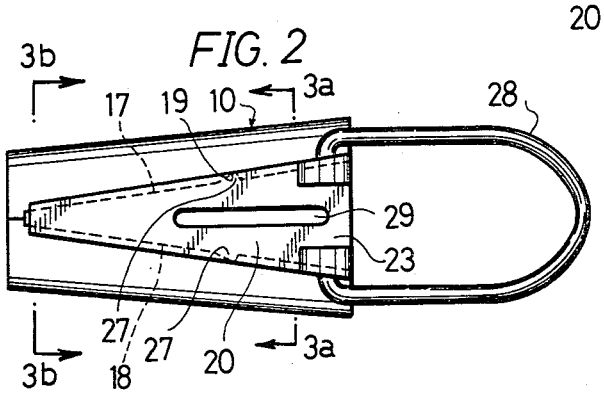
FIG. 2 is a top plan view showing the outer tubular member and the internal solid member after they have been assembled.
Figure 3B:
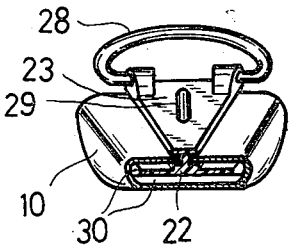
FIG. 3*b* is a cross section taken along the line 3*b*—3*b* of FIG. 2.

The internal solid member 20 is of such a configuration as permits insertion into said outer member 10, so that a tape-folding passage 30 can be provided between the internal wall of the member 10 and the outer wall of the member 20, as best shown in FIGS. 3*a* and 3*b*. More particularly, the internal member 20 is gradually reduced or tapered from its rear end 21 toward its front end 22, so that said front end 22 presents such an appearance as a thin plate as best shown in FIGS. 1 and 3*b*.

The member 20 has a platform 23 formed with its top side. The platform 23 is of a substantially triangular shape corresponding to said top opening 15 of the outer member 10 and exposed out of said opening 15. The platform has an axial side groove 24 formed in each of a pair of side walls 25, 26, so that said edges 17, 18 of the outer member 10 can be engaged with the grooves 24, respectively, when the members 10, 20 are assembled together.

Each of the side walls 25, 26 has a small projection 27, preferably wedge-shaped, which can be engaged with said notch 19 of the outer member 10 when the members 10, 20 are assembled together. The projection cooperates with said notch 19 and serves as a stopper means for preventing the internal member 20 from being disengaged from the outer member 10.

A handle means, preferably in the form of a ring 28 hinged to the rear end of the member 20, is mounted to the device for the known purpose to be hereinafter described. The member 20 is formed with an axial slot 29 which extends vertically from the top side to the bottom side of the member 20 through the entire thickness of the member 20, as best shown in FIG. 3*a*. The function of the slot 29 is known but will be described hereinafter with reference to FIG. 4.

The members 10, 20 prepared separately are finally assembled together by inserting the internal member 20 into the outer member 10 until the front end 23*a* of the platform 23 comes into contact with the vertex 16 of the top opening 15 of the outer member 10. It will be easily understood that, when the internal member 10 is inserted into the outer member 10, the wedge-shaped projections 27 of the internal member 20 can be forcibly engaged with the mating notches 19 of the outer member 10 and that, once engaged with each other, the projections 27 and the notches 19 cooperate to restrict undesirable disengagement of the members 10, 20.

When the members 10, 20 have been thus assembled together, the tape-folding passage 30 is formed between the internal wall of the outer tubular member 10 and the external wall of the internal solid member 20. The tape-folding passage 30 is of substantially U-shape in cross section at the rear end of the device, as shown in FIG. 3*a*, but gradually changed in its configuration into a final, flat annular shape at the front end of the device, as best shown in FIG. 3*b*.

Figure 4:
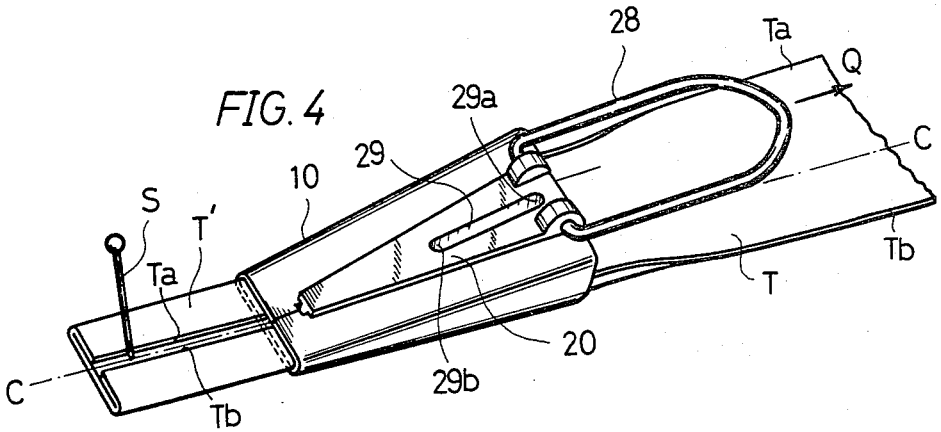
FIG. 4 is a perspective illustration showing how to use the bias tape making device.
Figure 5:
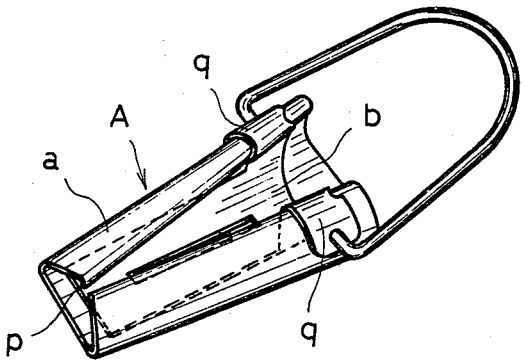
FIG. 5 PRIOR ART
FIG. 5 is a perspective view showing a typical example of a prior art device.
Figure 6:
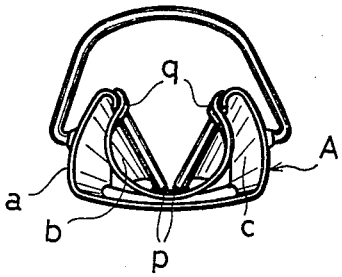
FIG. 6 PRIOR ART
FIG. 6 is a rear elevation of the prior art device shown in FIG. 5.

In operation, a material tape (T) is inserted into the device from the rear end of the tape-folding passage 30 toward the front end of the passage until the forward end of the tape (T) comes out of the end opening 13 in such a state or aspect that both of the longitudinal sides (Ta)(Tb) thereof are folded inwardly so as to extend in parallel with a center line (C) of the tape, as shown in FIG. 4. In case the tape (T) is too pliable to be inserted into the passage 30, an operator can use a suitable pointed tool or thing (not shown) such as a tailor awl, a bodkin, a needle, a pin or the like instantly available at hand. After inserting any one of these pointed tools or things into the rear end portion 29*a* of the slot 29 so that the pointed end of the employed tool or thing is engaged with the forward end portion of the tape (T) positioned near the rear end of the passage, the operator should axially move the inserted tool or thing toward the front end portion 29*b* of the slot, with the pointed end of the tool or thing kept engaged with the tape (T), so that the tape (T) can be forcibly fed forwardly. By repeating this step twice or thrice, the forward end of the tape (T) comes out of the end opening 13 of the device in the desired folded state.

Then, the forward end of the tape (T) is fixed on a plane by a desired fixing means, for example by a pin (S), in such a manner as illustrated in FIG. 4. After that, the operator holds the ring 28 with his fingers of one hand to pull it in the direction of an arrow (Q), while he uses a known iron or the like with his other hand to press the folded portion (T') of the tape as it comes out of the end opening 13 of the tape making device, in order that the folded state of the tape (T) can be fixed permanently. Thus, the desired folded bias tape can be obtained.

The present invention being thus described, it will be obvious that same may be varied in many ways. Such variations are not to be regarded as a departure from the spirit and scope of the present invention, and all such modifications as would be obvious to one skilled in the art are intended to be included within the scope of the following claims.

I claim:

1. A hand device for making a bias tape comprising:

an outer tubular member made of metallic sheet material and having a substantially oval rear end opening and a slit-shaped front end opening;

said outer tubular member being gradually reduced or tapered from its rear end toward its front end;

said outer tubular member having a top opening of a substantially triangular shape defined by a vertex positioned near said front end and a pair of sides divergently extending from said vertex;

an internal solid member made of synthetic resin material and being gradually reduced or tapered from its rear end toward its front end at its top side so as to be exposed out of said top opening;

said platform having a pair of said walls engaged with said pair of sides, respectively;

said outer tubular member and said internal solid member being assembled together by inserting the latter into the former;

a tape-folding passage formed between an internal wall of said outer tubular member and an external wall of said internal solid member; and said passage having a substantially U-shaped configuration in cross section at its rear end and being gradually changed in its configuration so as to provide a substantially flat annular configuration in cross section at its front end.

2. The hand device as defined in claim 1, wherein each of said pair of side walls of the platform is formed with an axial groove with which said sides are engaged, respectively.

3. The hand device as defined in claim 2, wherein any one or both of said pair of sides are formed with a notch, and any one or both of said side walls are formed with a small projection having such a size and configuration as can be engaged with the notch disposed on the same side therewith.

4. A hand device according to claim 1, wherein said internal solid member includes a slot therethrough to aid in the insertion of bias tape into said tape-folding passage.

5. A hand device according to claim 1, and further including a ring affixed to said internal solid member for grasping and pulling said hand device.

* * * * *